US005694846A

United States Patent [19]

MacPhee

[11] Patent Number: 5,694,846

[45] Date of Patent: Dec. 9, 1997

[54] FOUNTAIN SOLUTION SUPPLY SYSTEM

[75] Inventor: John MacPhee, Rowayton, Conn.

[73] Assignee: Baldwin Graphics Systems, Inc., Shelton, Conn.

[21] Appl. No.: 465,568

[22] Filed: Jun. 5, 1995

Related U.S. Application Data

[63] Continuation of Ser. No. 185,108, Jan. 21, 1994, abandoned, which is a continuation of Ser. No. 711,314, Jun. 6, 1991, abandoned.

[51] Int. Cl.[6] ..... B41F 7/32

[52] U.S. Cl. ..... 101/148

[58] Field of Search ..... 101/147, 148, 101/207–210, 363, 364, 350, 366; 118/259, 688, 690, 691

[56] References Cited

U.S. PATENT DOCUMENTS

| | | | |
|---|---|---|---|
| 2,238,050 | 4/1941 | Goedike | 101/148 |
| 2,637,336 | 5/1953 | Emery, Jr, | 101/148 X |
| 3,168,037 | 2/1965 | Dahlgren | 101/148 |
| 3,352,317 | 11/1967 | Dahlgren | 101/148 X |
| 3,769,909 | 11/1973 | Fugman et al. . | |
| 4,388,864 | 6/1983 | Warner . | |
| 4,455,938 | 6/1984 | Loudon | 101/148 |
| 4,469,024 | 9/1984 | Schwartz et al. . | |
| 4,479,433 | 10/1984 | MacPhee et al. . | |
| 4,505,154 | 3/1985 | Wiesner . | |
| 4,722,274 | 2/1988 | Jeschke . | |
| 4,724,764 | 2/1988 | MacPhee et al. | 101/451 |
| 4,777,877 | 10/1988 | Lemaster | 101/426 |
| 4,841,855 | 6/1989 | Marcum | 101/148 |
| 4,981,077 | 1/1991 | Alvarez . | |

FOREIGN PATENT DOCUMENTS

| | | | |
|---|---|---|---|
| 0132624 | 2/1985 | European Pat. Off. . | |
| 277879 | 8/1988 | European Pat. Off. . | |
| 296394 | 12/1988 | European Pat. Off. . | |
| 403382 | 12/1990 | European Pat. Off. . | |
| 1904178 | 8/1970 | Germany . | |
| 1761908 | 9/1971 | Germany . | |
| 93351 | of 0000 | Japan | 101/363 |
| 109763 | 8/1981 | Japan | 101/350 |
| 1439002 | 6/1976 | United Kingdom . | |

OTHER PUBLICATIONS

A copy of GB 1235916, said to be an equivalent of this reference, is attached.

Graphic Arts Monthly, Sep.–Nov. 1984, "Recent Trends and Developments in Lithographic Dampening" by John MacPhee.

"The Handling and Care of Fountain Solution" by John MacPhee (reprint of speech). GATF/R&E Council; Feb. 18, 1976.

*Primary Examiner*—J. Reed Fisher

*Attorney, Agent, or Firm*—Morgan & Finnegan LLP

[57] ABSTRACT

A system for supplying dampening fluid to a lithographic press dampening system. The system prevents dampening fluid starvation at a metering nip located between dampening system rollers, and minimizes contamination of the dampening fluid in the dampening system. A pre-determined distance is maintained between (1) the surface of a roller partially immersed in dampening fluid and (2) a fluid collection pan, so as to remove contaminants from the system. Sensors are used to determine the proper level of dampening fluid within the system to avoid nip starvation.

7 Claims, 9 Drawing Sheets

FOUNTAIN SOLUTION SUPPLY SYSTEM

This is a continuation of application Ser. No. 08/185,108, filed on Jan. 21, 1994, now abandoned, which is a continuation of application Ser. No. 07/711,314 filed Jun. 6, 1991, now abandoned.

This invention relates to a new and improved fountain solution (dampening fluid) supply system for use on lithographic printing presses. Generally speaking, the invention relates to a new and improved system for supplying fountain solution to dampening systems of the contact or two-way type. More specifically, the invention relates to a new and improved fountain solution supply system for continuous contact type dampening systems which results in improved performance in the areas of reduced ink buildup on dampening system rollers, sharper printing, and less ink contamination of components in the fountain solution supply system.

BACKGROUND OF PRIOR ART IN THE FIELD OF THE INVENTION

It is well known that the lithographic offset printing plate is treated chemically so that there are printing and non-printing areas so that the printing area is receptive to ink. The non-printing area, on the other hand, is hydrophilic and accepts moistening fluid. In order to achieve the desired printing, a film of moistening fluid is applied to the surface of the plate which is retained by the hydrophilic area but which beads up on the printing area thereby allowing the printing area to receive the printing ink. The non-printing area, thus, is separated and isolated from the inking rollers by the film of moistening fluid. In this manner only the printing or image area receives ink which is then transferred to the blanket cylinder and onto the paper on which the image is printed. The purpose of lithographic dampening systems is to feed moistening or dampening fluid to the printing plate.

One method of categorizing dampening systems is in terms of whether or not a return path for fountain solution exists between the plate cylinder on the printing press and the metering elements of the dampening system. Dampening systems of the brush and spray types contain a physical gap between the means for metering the dampening fluid, or fountain solution, and the plate cylinder and, as a result, fountain solution can travel in one direction only, that is toward the plate. Thus, dampening systems in this category are referred to as the non-contact or one-way type.

In contrast, dampening systems of the contact type do not contain a physical gap in the path of the fountain solution, thus making it possible for fountain solution to travel to and fro between the metering means in the dampening system and the plate cylinder. Thus, this second general class of dampening systems has also been referred to as the two-way or contact type dampening system. Contact or two-way type dampening systems are further divided in continuous types and conventional or ductor types. The vast majority of modern contact type dampeners are of the continuous type and generally contain either three or four rollers; hence this class of dampeners are often referred to as either a three-roller or a four-roller design.

FIG. 1 illustrates a typical modern non-contact type dampener which uses a rotary brush to flick off fine droplets of fountain solution from a pan roller in a pan and to propel the droplets across a gap toward a chrome surfaced vibrating roller in the dampening system. Metering of the amount of dampening fluid that is delivered to the vibrating roller is accomplished by varying the speed at which the pan roller delivers fountain solution to the point where it is flicked away by the bristles of the rotating brush. A major advantage of this type of dampener is that no ink is fed back to contaminate the metering elements and the fountain solution supply system by virtue of the physical gap which exists in the path from the pan to the plate cylinder. There are, however, two major drawbacks to this type of dampening system design. First, there is no easy way to control the rate of flow in the lateral direction along the vibrating roller. Second, and perhaps more importantly, when overfeeding of dampening fluid to the plate occurs i.e. an excess of dampening fluid, the system cannot automatically compensate by returning some of the excess dampening fluid back to the supply system. This can cause a degradation in print quality and can result in more waste. As a result, brush systems require more operator time and skill to achieve good quality printing.

Spray type dampeners meter dampening solution by the use of a plurality of atomizing spray nozzles which direct a pulsed flow of fine drops of fluid across a physical gap onto a dampening or inking roller. The use of many nozzles makes it possible to control flow laterally and the one-way character of the design eliminates the problem of ink contamination in the dampening fluid supply system. Spray systems, however, retain the drawback of one-way designs in that there is no automatic compensation for overfeeding. Thus print quality often suffers when using spray type dampeners. A typical example of a spray dampener is illustrated in U.S. Pat. No. 4,469,024 to Schwartz et al issued Sep. 4, 1984.

U.S. Pat. No. 4,724,764 to MacPhee et al issued Feb. 18, 1988 illustrates various embodiments of the three-roller continuous contact type dampening system. U.S. Pat. No. 4,777,877 to Lemaster issued Oct. 18, 1988, illustrates one embodiment of the four-roller continuous contact type dampening system. In both three and four-roller designs metering of the dampening fluid is accomplished by a pair of rollers squeezed together so as to limit the amount of fluid which passes through their junction or nip. More specifically, the amount of fluid metered is adjusted by varying either the speed, pressure setting, or hardness of the rollers. This scheme requires that an excess amount of fountain solution be fed to the inlet side of this metering nip. This is normally accomplished by partially immersing one of the rollers in a pan containing fountain solution, so that an excess of dampening fluid is carried by the roller from the pan to the metering nip, with excess fluid automatically flowing back down into the pan.

In order to avoid slinging of dampening fluid, the metering rollers are normally limited to speeds in the range of 150 to 200 feet per minute. Thus most three and four-roller continuous contact type dampening systems manufactured today are characterized by the existence of a slip nip in the fluid path between the metering or squeeze rollers and the plate cylinder. Slip nips are characterized as nips formed by rollers travelling at significantly different surface speeds. For example, in a modern web offset press, the plate cylinder and most rollers on the press may travel at a speed of 1,500 feet per minute whereas the pair of squeeze rollers in the dampening system may be driven separately at a speed one tenth that or 150 feet per minute. Thus a slip nip must exist.

One other unique characteristic of most continuous contact three-roller and four-roller type dampening systems is that the metering or squeeze roller pair is arranged so that any fluid contained in the metering nip will drain out in a circumferential direction over one of the two roller surfaces, whenever the rollers stop turning or if excess fluid is supplied to the nip. An additional feature normally found in such dampening systems is a fountain solution circulating system, consisting basically of a pump and tank or reservoir for maintaining a constant volume of fluid in the pan.

Because fountain solution is free to flow back and forth between plate cylinder and metering rollers, overfeeding of fountain solution to the plate is automatically compensated for by an increase in the back flow from plate cylinder to the metering rollers. This feature, plus the ability to vary lateral flow by skewing of one of the metering rollers, makes this class of dampeners very user friendly and capable of producing very high print quality. A drawback of this type of dampening system, however, is that the large inventory of fountain solution contained in the pan and the circulating system often rapidly becomes contaminated with ink, which results in degradation of print quality, buildup of emulsified ink on dampening system rollers, and the need to periodically clean the circulating system. Various attempts to solve these problems by installing filters to remove the offending ink particles from the dampening fluid have been largely unsuccessful.

A continuous contact type dampener system equipped with a spray-type fluid supply system is disclosed in Marcum U.S. Pat. No. 4,481,855 entitled "Dampening Unit For Printing Press" dated Jun. 27, 1989. The purpose of the spray-type supply is to prevent pick-up of lint and debris that may collect in the pan. Thus no attempt was made to minimize either the volume in the metering nip or the amount draining away from the metering nip. Another variation of a continuous contact type dampening system is disclosed in Loudon U.S. Pat. No. 4,455,938 entitled "Dampening Apparatus for Lithographic Press" dated Jun. 26, 1984. The unique features of this design are that only two rollers are used and that both metering or squeeze rollers travel at press speed.

OBJECTS OF THE INVENTION

It is, therefore, an object of this invention to provide a new and improved dampening fluid supply system for use in conjunction with two-way or contact type dampening systems.

It is another object of this invention to eliminate and/or reduce ink contamination of components in the dampening fluid supply system.

A further object of this invention is to eliminate and/or reduce the need for filters to remove ink fed back into the dampening fluid supply system by two-way or contact type dampening systems.

Another object of this invention is to provide a new and improved dampening fluid supply system which improves the print quality on presses equipped with contact or two-way type dampening systems.

A still further object of this invention is to reduce or eliminate the buildup of ink on the rollers of two-way or contact type dampening systems.

An object of this invention is to impart to contact type dampening systems the advantages of non-contact types, while still retaining all of the advantages inherent in the former.

A still further object of this invention is to provide a new and improved dampening fluid supply system for use in conjunction with contact or two-way dampening systems which is less expensive to manufacture.

Additional objects and advantages of the invention will be set forth in the description which follows and, in part, will be obvious from the description; the objects and advantages being realized and obtained by means of the instrumentation, parts apparatus, systems, steps and procedures particularly pointed out in the appended claims.

BACKGROUND DESCRIPTION OF THIS INVENTION

The invention herein is particularly useful for use with contact type dampening systems. A large majority of the contact type dampening systems manufactured today use the squeeze roll principle to meter out a thin film of dampening fluid, which is then further thinned before being transported and applied to the plate cylinder on the press. In this method of metering, a hard surfaced roller and a compliant surfaced roller are forced into contact with one another and one of the rollers is partially immersed in a pan or tray containing dampening fluid. This roller pair is geared together and connected to a motor drive which causes the two rollers to turn in counter rotating directions.

As shown by the three-roller designs in FIG. 2, two different configurations for a contact type dampening system are used. Thus as shown, Configuration A illustrates a pan roller in engagement with a transfer and metering roller which contacts a form roller. Configuration B shows a pan roller in engagement with a metering roller and a form roller. However, the two configurations possess common metering nip characteristics. That is, the roller immersed in the pan carries an excess of fluid to the metering nip, which results in the nip becoming flooded and in the excess fluid falling back into the pan. FIG. 2 also shows the location of the slip nip that is normally present as a consequence of driving the metering or squeeze roller pair at a lower surface speed than the plate to prevent slinging of dampening fluid. The volume or inventory contained in the pan is typically a gallon or more, depending on the size of the press. The total inventory of dampening fluid is increased further by as much as a factor of five or more by the use of additional components in the fluid supply system for circulating, cooling, and filtering the dampening fluid. This inventory of dampening fluid often becomes contaminated with ink fed back from the plate via the dampening system and the form roller which is in contact with the plate cylinder. These contaminants are the cause of many problems as a result of their deposition on various components of the dampening and fluid supply systems.

The invention disclosed here resulted from the discovery that only a small volume or inventory of fluid is needed to maintain the proper metering performance of a pair of squeeze rollers. More specifically, it was discovered during initial printing tests that proper dampening system performance could be achieved by draining the pan in which one of the rollers is normally immersed and by keeping the entrance of the metering nip filled with the aid of a hand operated spray bottle, similar to the spray bottle used to clean windows. It was also discovered that a volume of dampening fluid large enough to sustain normal printing operations for a period of 10 to 20 seconds could be stored in the nip entrance without overflowing, i.e., draining back down the lower of the two rollers.

In subsequent printing tests, it was discovered that improved printing performance resulted when the volume of fluid in the supply system was reduced to a small quantity in this way. Although the reasons for this improvement are not fully understood at this time, it is theorized that the improvement is due to the corresponding reduction in mean fluid residence time. Mean fluid residence time is defined as the average time a particle of fluid resides in the fluid supply system before it is carried into the metering nip formed by the dampening system squeeze rollers. For example, the mean fluid residence time in a conventional supply system may be 90 minutes or longer. In contrast, the mean fluid residence time in the second series of press tests was less than one half minute or shorter by a factor of over 200. Although the upper limit on mean fluid residence time may vary depending on such factors as press speed and dampening system configuration, it is probable that it should not exceed five (5) minutes in order to realize the benefits of this invention.

It was further discovered that when an excess of fluid was fed into the metering nip, overflowing or back-flowing occurred in the form of rivulets, as shown in FIG. 3. Initially, it was thought that overflowing could then be determined by simply sensing the presence of a single rivulet anywhere along the length of the roller and that the metering nip could then be refilled or replenished by periodically feeding fresh dampening fluid uniformly along the nip length. However, during subsequent printing tests it was discovered that this was not correct and that lateral zones on the printing plate which contain larger image areas (i.e., heavier ink coverage) require more dampening fluid, with the result that fluid in the corresponding lateral zones of the metering nip is consumed faster. This results in starved or depleted sections of the metering nip, as shown in FIG. 4. There it can be seen that the zone of heavy coverage does not result in the formation of excess rivulets of dampening fluid. Based on these experiments, it became evident that an overflow sensor should be provided but divided into zones so that independent feed means corresponding to the sensor zones can be provided. In addition, within each zone further subdivisions of the sensors are needed to avoid blinding of a sensor by overflows in an adjacent zone. That is, a starved region can be supplied by fluid flowing into it laterally along the nip from an adjacent flooded region. Experience has shown that a starved region of a length of up to four inches or more can be so supplied. Thus, each sensor should not cover a nip length of more than about three or four inches to insure that a starved region of longer than three or four inches cannot exist. For example if nine inch wide sensors were used it would be possible for a seven or eight inch long starved region to exist undetected in the zone covered by a given sensor, since the given sensor could be erroneously detecting fluid that had flowed laterally into the edges of its range, from an adjacent region.

The invention is capable of utilizing certain devices and sensors known in the art. For example, various sensing techniques, familiar to those skilled in the art, can be used to sense when overflowing or overfilling of the nip occurs. These include passive listening devices, as described in U.S. Pat. No. 4,505,154, ultrasonic ranging sensors as described in U.S. Pat. No. 4,479,433 and sensors which respond to changes in capacitance.

BRIEF DESCRIPTION OF INVENTION

Briefly described, the present invention relates to an improved dampening fluid supply system used in conjunction with a two-way type dampening system in which the volume or inventory of dampening fluid, that can come in contact with the dampening system rollers, is very small. The invention thus takes advantage of the discovery that the nip between adjacent contacting dampening feed rollers contains sufficient fluid for printing. This is accomplished by providing a sensor to determine at the nip when makeup dampening fluid is necessary and should be fed and then only feeding enough fresh dampening fluid to flood the metering nip in the dampening system.

In the preferred embodiment a multi-section sensor monitors discrete zones along the metering nip between the rollers to determine that overflowing is occurring. Whenever overflowing in a given zone ceases, the corresponding section of the sensor generates a signal which at the appropriate time causes a small volume of dampening fluid to be fed to the nip, thereby replenishing the depleted zone. This invention further includes a new and novel sensing mechanism which is particularly adapted to achieve the objects of the invention herein.

In an alternate embodiment, overflowing dampening fluid is collected in a shallow trough where its level is monitored by a sensing means. Whenever it is detected by the sensing means that the small volume of dampening fluid in the trough decreases below a predetermined prescribed level, a signal is generated to a feeding means which causes a small volume of dampening fluid to be fed to the trough so as to restore the level of dampening fluid to the predetermined predescribed level.

In a still another embodiment, dampening fluid is periodically fed to the metering nip by a multi-section manifold, in quantities that are large enough to keep the metering nip flooded but not so large as to cause significant overflowing of the metering nip. Both the time between feed periods and the amount of fluid supplied during each feed is governed by a signal proportional to press speed and by adjustments made by the press operator.

In yet another embodiment, the metering rollers are rearranged so that dampening will remain and not be drained away from the metering nip when the rollers stop moving. The level in the nip is monitored by a sensing means. Whenever it is detected by the sensing means that the small volume of dampening fluid in the nip decreases below a predetermined prescribed level, a signal is generated to a feeding mans which causes a small volume of dampening fluid to be fed to the nip so as to restore the level of dampening fluid to the predetermined pre-described level.

In addition, the invention includes a sensor mechanism particularly adapted for the environment of the field of this invention.

The invention consists of the named parts, constructions, arrangements and improvements shown and described.

The accompanying drawings which are incorporated in and constitute a part of this specification illustrate an embodiment of the invention and together with the detailed description serve to explain the principles of the invention.

DETAILED DESCRIPTION OF INVENTION

Reference is now made to particular detailed embodiments of the invention.

Figure 5A:
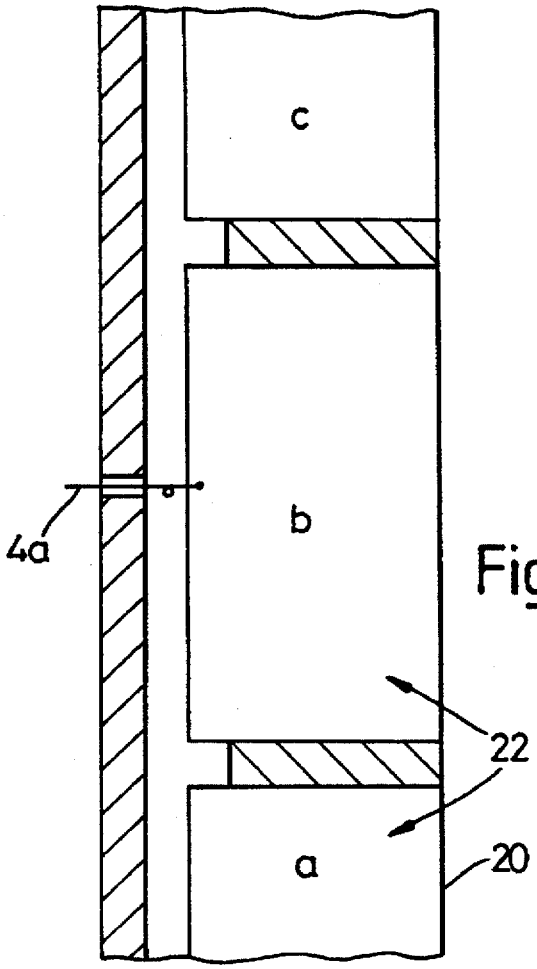
FIG. 5A is a sectional view taken along line A—A of FIG. 5.
Figure 5:
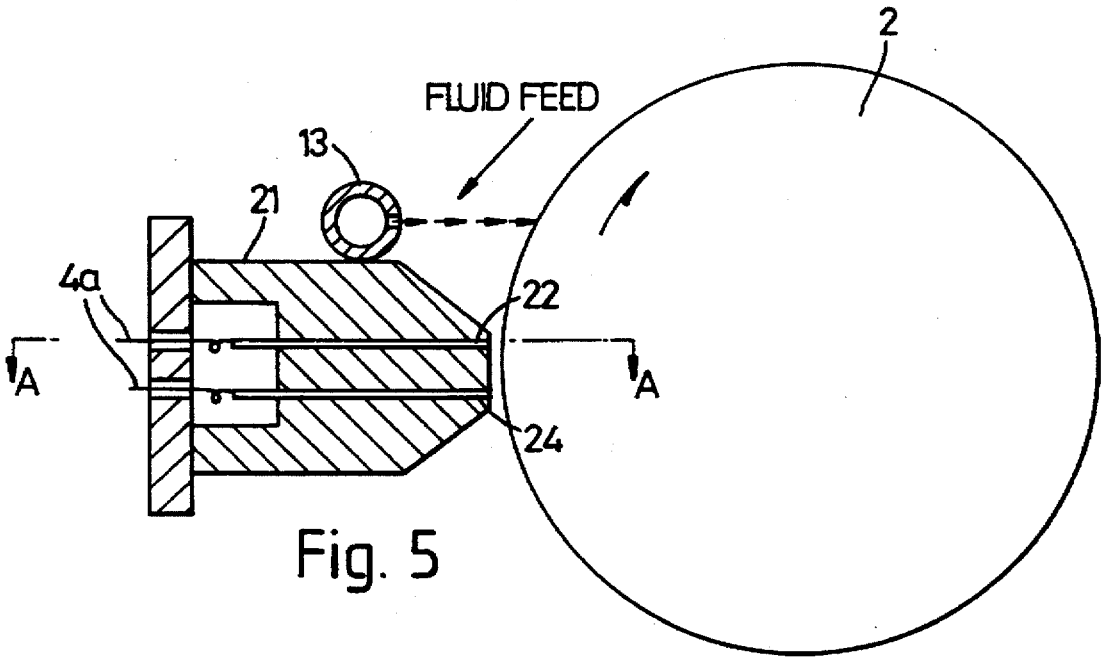
FIG. 5 is a view partially in section showing a sensor bar assembly embodiment of the present invention.
Figure 6:
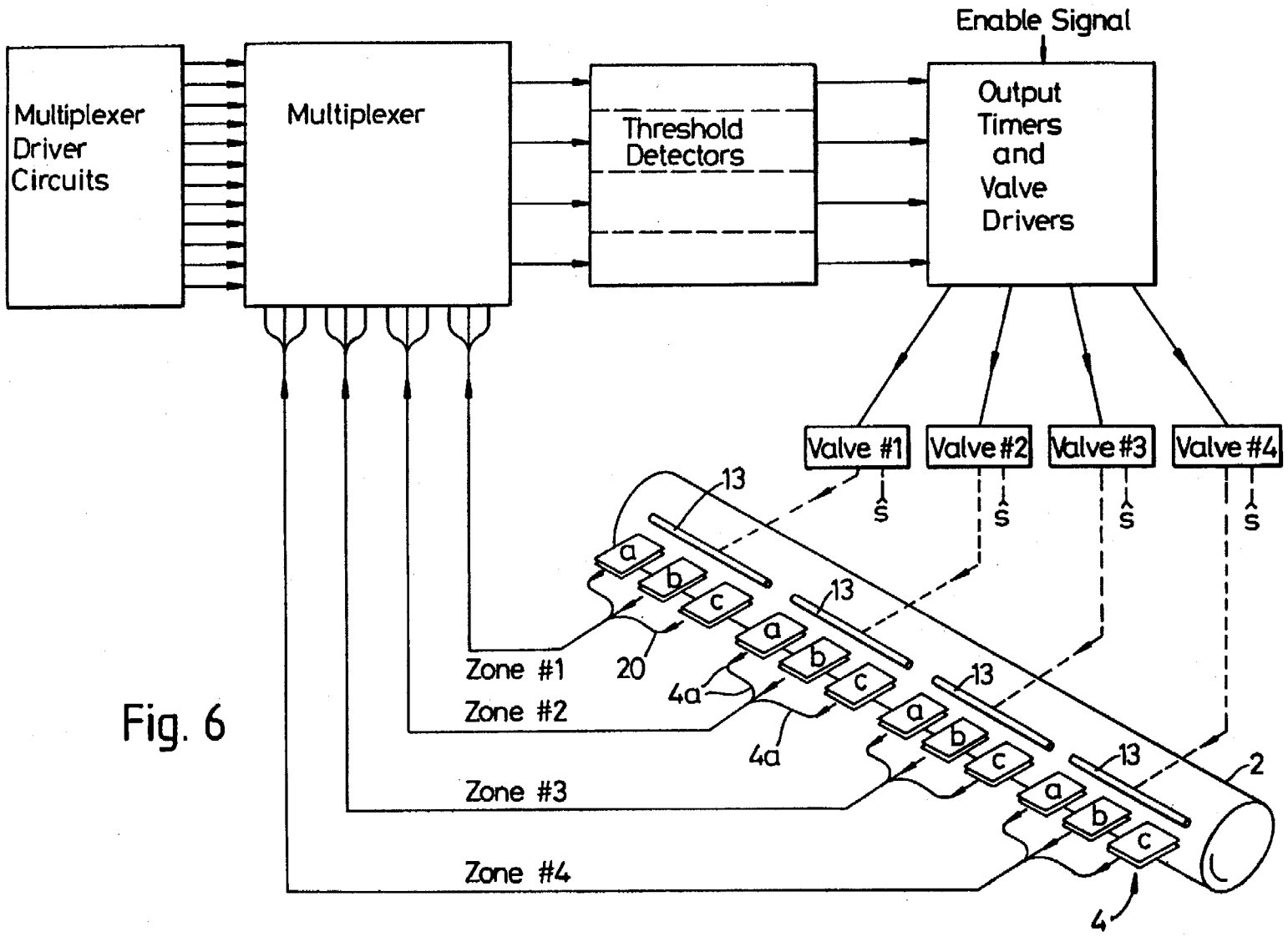
FIG. 6 is a schematic of one embodiment of the invention showing various block diagrams of instrumentation.

As shown in FIG. 6, there is a pan roller 2 extending along the width of the press and a plurality of manifolds 13 extending substantially along the length of the pan roller. A plurality of sensors 4 are spaced along the length of the roller 2 which may be of the type described with reference to FIG. 5 and FIG. 5A although the invention is not limited thereto. The sensors 4 send signals to the multiplexer driven by the multiplexer driver circuits in a manner known to those skilled in that art. The multiplexer receives the signals from the sensors which in turn signals the threshold detectors which signal the output timers and valve devices. Each output timer and valve driver include a timing mechanism and a signal capable of opening a selected valve for a predetermined period of time to provide dampening fluid to the manifold 13 at the appropriate time and for a predetermined time period.

It will be understood that the hardware referred to herein, except as specifically described, are known to those skilled in the art and the details thereby are not shown or necessary to the practice of this invention.

Figure 1:
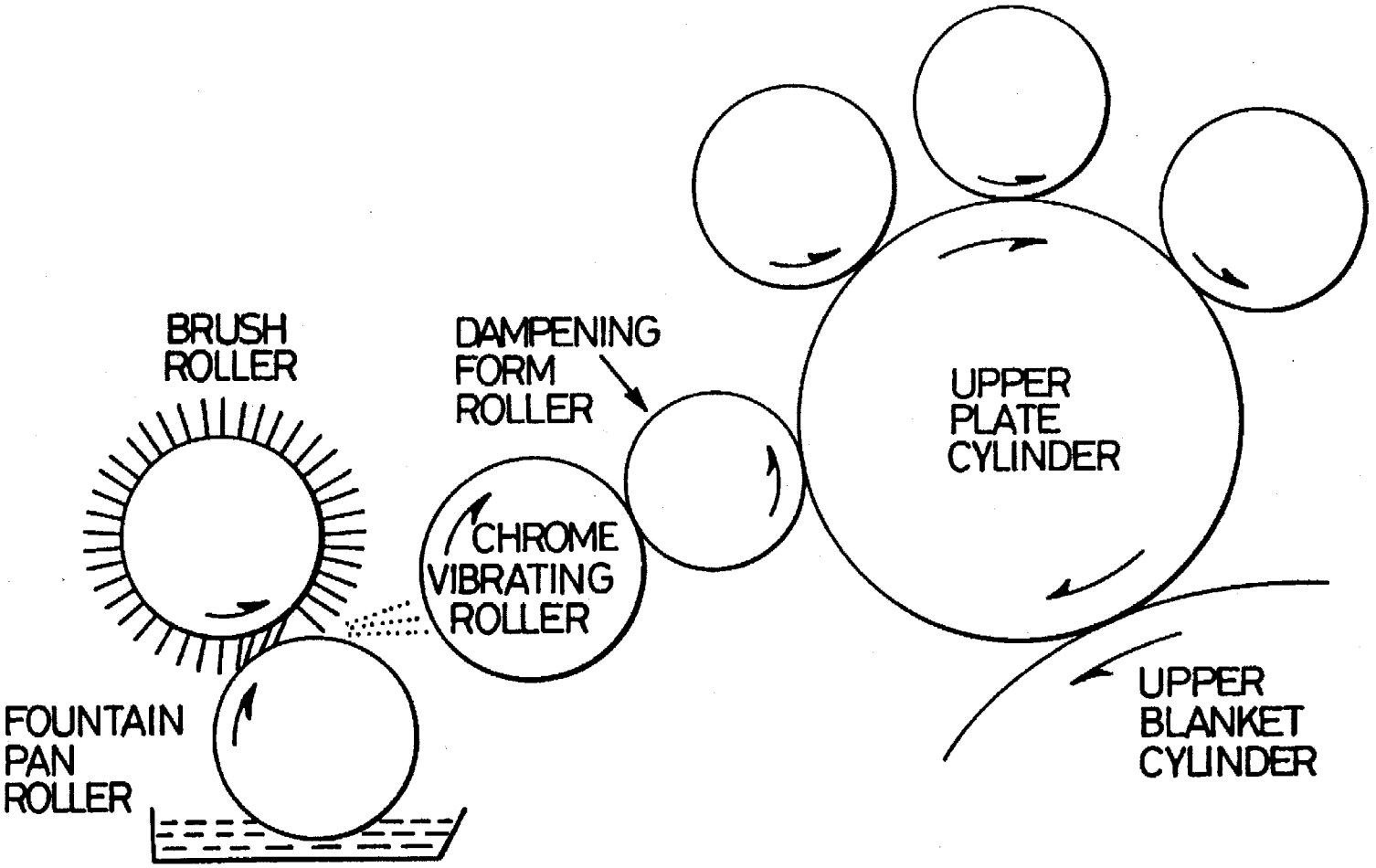
FIG. 1 is an example of a prior art brush type dampener.
Figure 2:
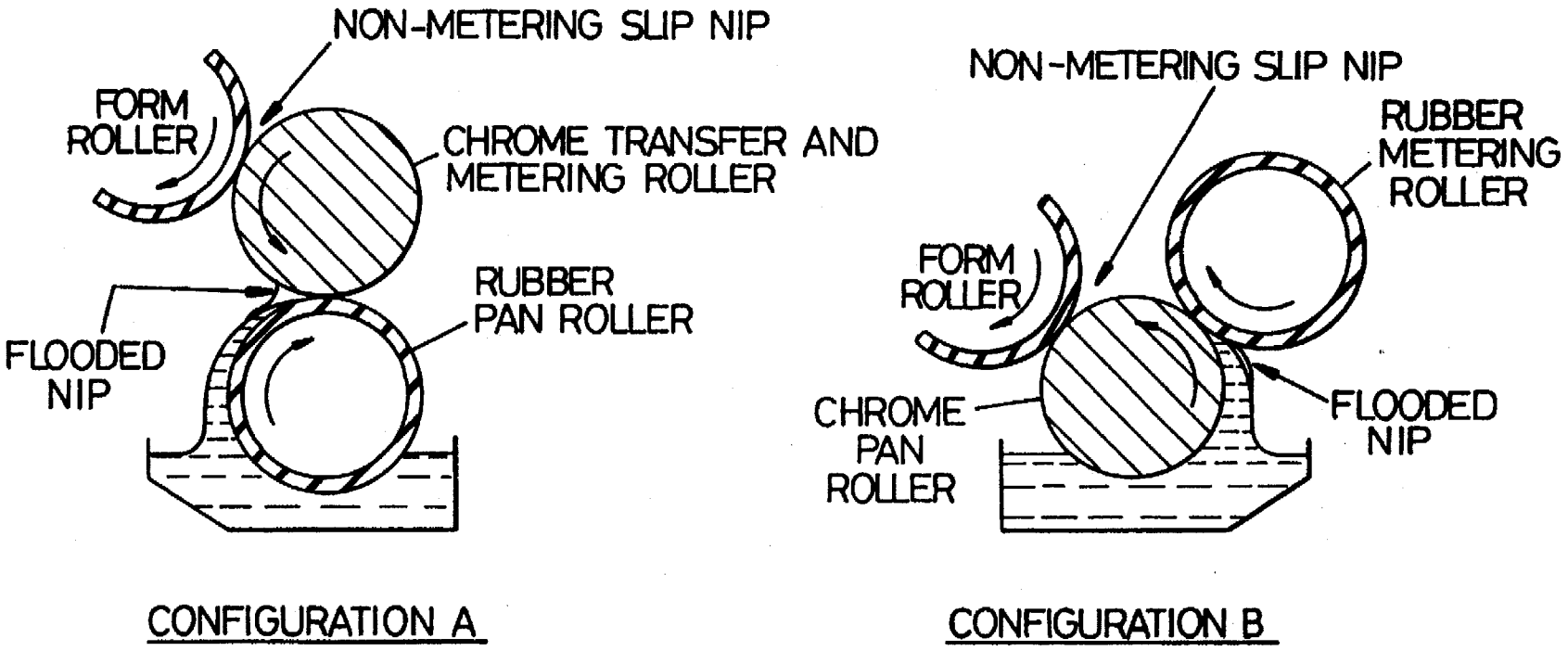
FIG. 2, is a diagram which illustrates prior art squeeze roll metering systems in Configuration A and Configuration B.
Figure 3:
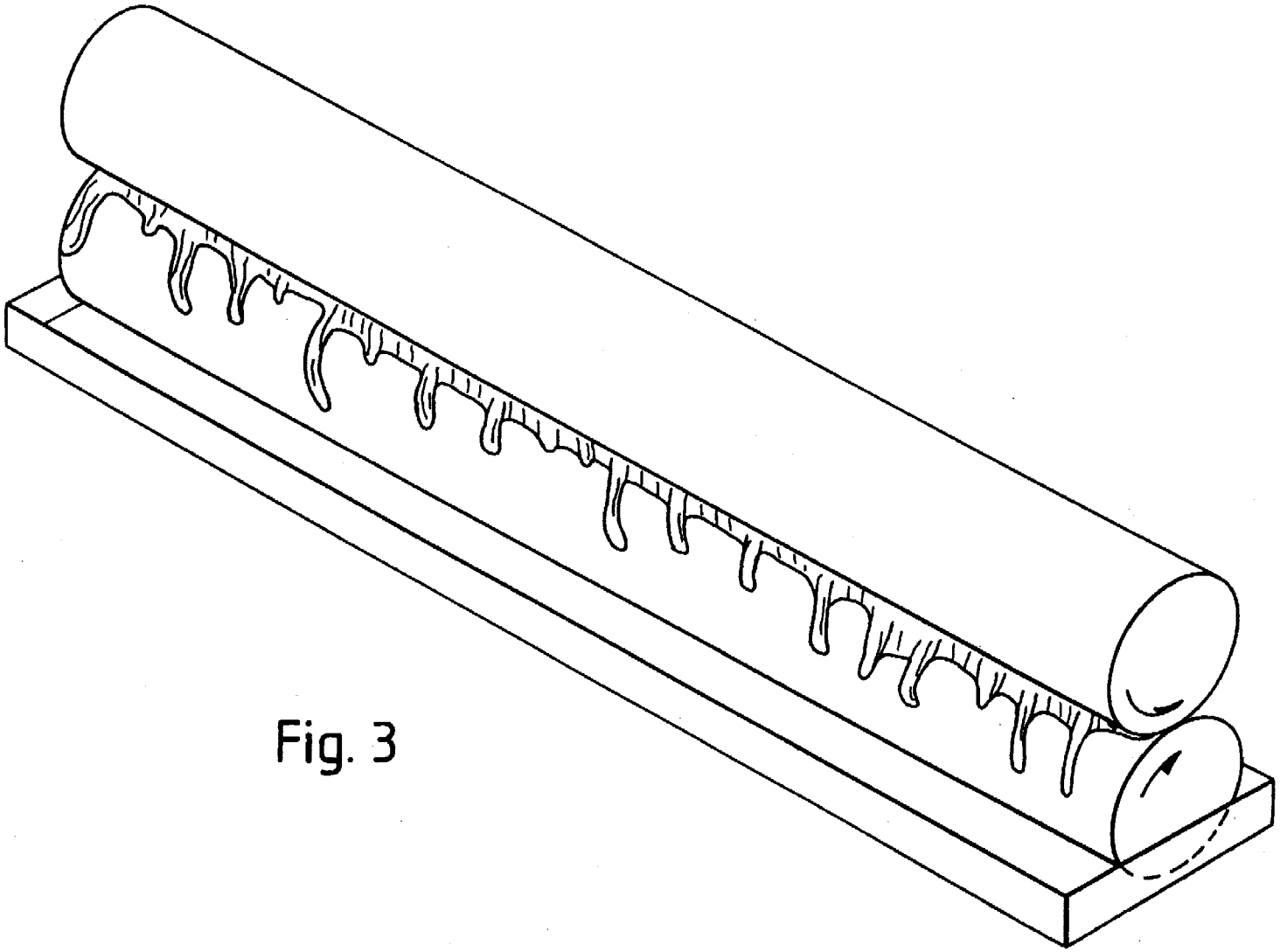
FIG. 3 is a sketch of a test done in making the invention in which rivulets flow back down the fountain pan roller when feed to the metering nip is excessive.

FIG. 6 is a schematic of the complete system used to supply fluid to a dampening system on a 38 inch wide press. As shown there is a pan roller 2 extending along the width of a lithographic press which is the position of the usual pan roller shown in FIG. 2. The pan roller 2 forms a nip area with another roller of the type shown in FIG. 2 but not shown in FIG. 6 for purposes of clarity. Thus, the nip is found or formed between the pan roller 2 and the transfer metering roll (Configuration A) or between the pan roll 2 and the metering roll (Configuration B).

In accordance with this invention means is provided for sensing the volume of dampening fluid in the nip at a plurality of locations along the length of the nip.

As embodied, arrayed along the axis of the roller 2 to be supplied with dampening fluid are a plurality of sensors 4 arranged in groups. As illustrated, there are twelve (12) sensors in groups of three so as to provide four zones, identified as Zone 1, Zone 2, Zone 3 and Zone 4, of control. The output leads from the sensors 4 shown by arrows are connected through cables to a multiplexer referred to by the block diagram. The multiplexer may be a 4066 CMOS type integrated circuit which is a generic device available from several U.S. manufacturers. The purpose of the multiplexer is to sample or connect one sensor at a time in the group to a threshold detector to determine if an overflow condition exists at that sensor location. When a conductivity type sensor is utilized, the threshold detector may consist of a wheatstone bridge of conventional type connected to a type 3130 operational amplifier, which is a BIMOS integrated circuit device manufactured and sold by Harris Semiconductor. The threshold detector generates no control action at its output if there is an excess of dampening fluid at the position of the sensor 4 which is connected to it by the multiplexer. Conversely, if flooding is not detected, by the sensor connected to it, the threshold detector will generate a signal at its output to initiate a control action. This is accomplished by connecting the sensor being sampled through the multiplexer to one leg of the wheatstone bridge. The null points of the bridge are connected to the input terminals of the operational amplifier in such a way that if flooding is detected, as evidenced by a low state of resistance between the parallel plates as explained in reference to FIG. 5, no control action is initiated by the system and no dampening fluid is supplied to the nip. If, however, overflowing is not sensed, as evidenced by a high state of resistance between the parallel plates, then a feed of dampening fluid in the zone being sampled is initiated. This is done by generating a signal from the threshold detector which starts the output timer assigned to the given control zone. The timer in turn is connected to a valve driver which energizes a valve identified as valves #1, #2, #3 and #4 for supplying pressurized dampening fluid to the zone manifold 13, thereby feeding dampening fluid to the roller in the region of the zone being sensed. The duration of the feed (valve open time) is governed by the corresponding timer which can be set in the conventional manner to maintain the valve open for a predetermined time period. The details of the manifold are conventional and consist in general of a hollow tube 13 with openings therein to direct the dampening fluid to the gap when appropriate. A separate manifold is provided for each zone.

Considerable latitude exists in selecting a sampling rate and a valve open time satisfactory for a given press, and those skilled in the art will have no difficulty in doing so depending on the situation. Similarly all of the control circuitry shown in FIG. 6 is commonplace and can readily be designed and built by a person skilled in the art. Thus, the units identified as multiplexer driver circuits, multiplexer, threshold detectors and output timers and valve drives are not the invention per se and can be built and/or obtained by those skilled in the art.

In accordance with this invention, sensor means is provided for determining the presence or absence of an overflow condition of dampening fluid at the nip.

Figure 4:
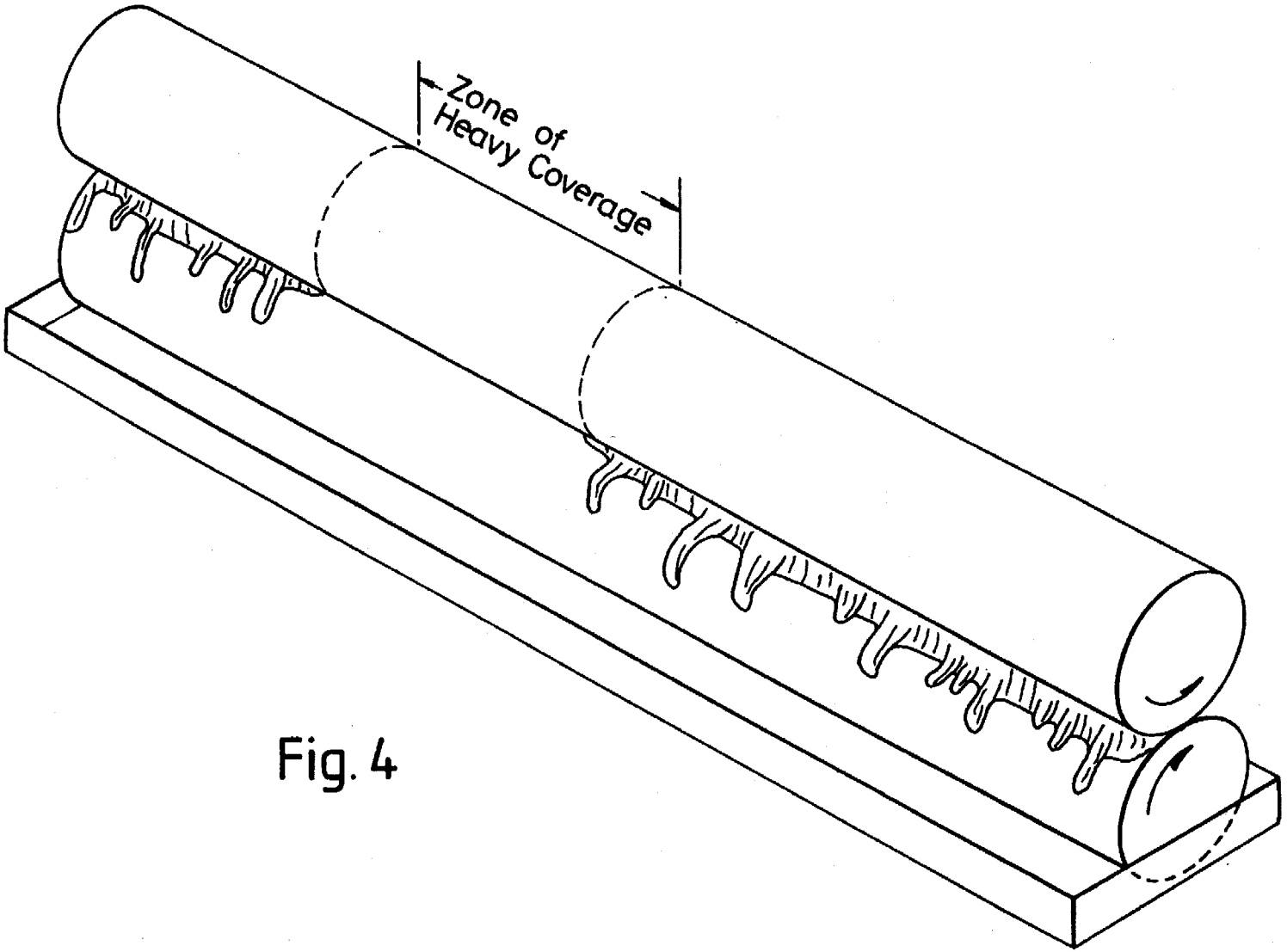
FIG. 4 is a sketch of a test done in making the invention showing non-uniformity of rivulets flow caused by zones of heavy coverage.

As embodied, the sensors 4 used in the preferred embodiment of this invention are groups of parallel conductivity probes 20, located along the axis of the pan roller, so as to intersect the overflow rivulets of the type shown in FIG. 4 (not shown in FIG. 5) at right angles. Each conductivity sensor consists of a pair of parallel electrically conducting plates 22, 24 having a width of about 2¾ inches spaced about ¼ inch apart and mounted approximately .025" away from the surface of the roller 2, as shown in FIG. 5. The plates are encased in plastic insulating material 21 of any suitable type, also as shown in FIG. 5. Because dampening fluid is a relatively good electrical conductor, an overflow rivulet which contacts both plates can be detected by the presence of an electrical current flowing in the circuit formed by a convenient voltage source connected to the two plates. On the other hand, if there is no rivulet resulting from overflow the circuit is open.

For a typical 38 inch wide modern web press, the following system parameters can be used for determining the sequence and timing of the operation.

By way of an illustration, the term "high sensor rate" refers to a state when no water is present so that there is a high resistance. The term "low sensor rate" refers to a state when water is present so that the circuit will be closed. "Sampling rate" refers to the time period for determining whether water is present in the nip. The term "valve open time" refers to the fact that the valve is in the open position.

High Sensor State (No Water in Nip)

A resistance between the parallel plates which exceed a value R which is in the range of 20–50 thousand ohms.

Lower Sensor State (Water in Nip)

A resistance between the parallel plates which equals or is less than the above value R.

Sampling Rate

A suitable range for the sampling rate is between once every six seconds to once every eighteen seconds.

Valve Open Time

A suitable range for valve open time is 0.5 to 2.5 seconds. The exact value will depend on the demands of the press and the design of the fluid supply system, designated by the symbol "S" in FIG. 6.

The relationship between minimum valve open time, usage rate, sampling rate, and the feedrate provided by the manifold and fluid supply system is as follows:

$$\text{Minimum Valve Open Time} = \frac{\text{Usage Rate}}{(\text{Feedrate})\,(\text{Sampling Rate})}$$

Example: A press where the maximum usage rate per plate cylinder is 0.5 U.S. gallons per hour, per zone, or about 1.0 fluid ounce per minute. If the available feedrate is 10 fluid ounces per minute and the sampling rate is once per 6.0 seconds, then the minimum valve open time is 0.6 seconds. In such a case, the valve open time should be set somewhat longer, e.g. 1.0 seconds, to provide a safety margin in the average feedrate.

Other design requirements recognized by those skilled in the art are that the voltage source applied to the parallel plates should be A.C. and that all sensors should be connected to ground when not being sampled. It is also necessary to disable the control system and stop feeding whenever the roller drive is turned off. To accomplish this a proximity sensor (not shown) is mounted adjacent to one of the roller drive gears and generates an enabling signal when motion is detected.

In accordance with an embodiment of this invention means is provided for supplying dampening fluid to the nip at the pan roller wherein a collection trough means capable of being replenished with dampening fluid is maintained so that the pan roller can deliver dampening fluid to the nip in a manner that prevents contamination. As embodied in FIG. 7, this means includes a pan roller 2 having a nip 40 at junction with another roller and means for controlling the supply of fountain solution available for delivery to the pan roller nip 40.

Figure 7:
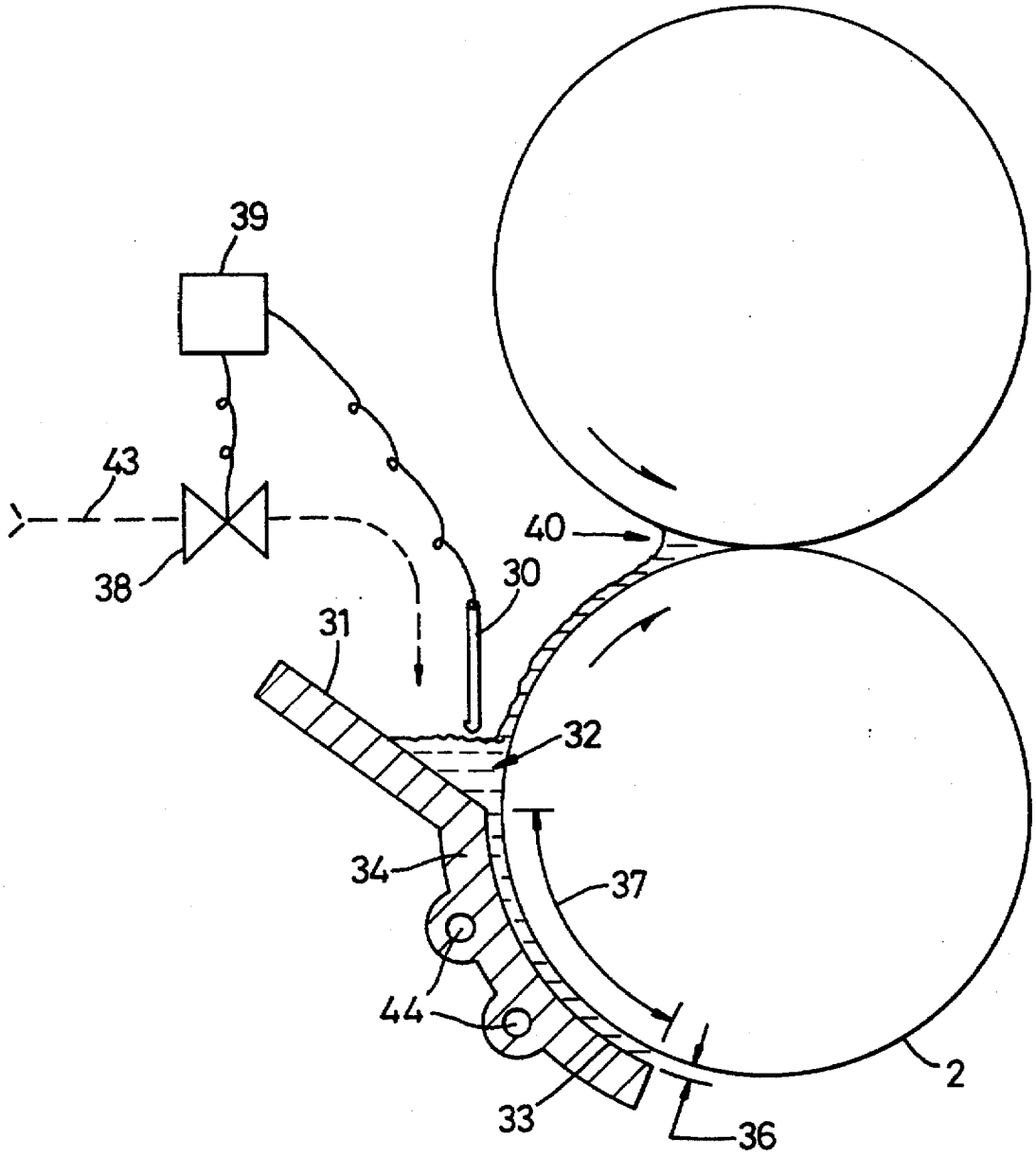
FIG. 7 is a schematic view of another embodiment of the invention.

In FIG. 7 there is shown sensing means used to determine the necessity of additional dampening fluid supply. As embodied, this means 30 consists of a single conductivity probe for detecting the presence of dampening fluid in a collection trough 32. The collection trough is formed by a conforming rail 34 extending along the length of the roller 2. The conforming rail includes an inclined surface 31 which forms the collection trough in cooperation with the surface of the pan roller. Extending from the inclined surface 31 is a curved surface 33. The curved surface 33 is on a radius substantially equal to the radius of the pan roll. As will be discussed, the surface 33 is spaced a predetermined distance from the adjacent surface of pan roll 2. As long as overflowing of the metering nip 40 occurs, the trough 32 will contain fluid along its entire length. It will be noted that the conforming rail 34 is adjacent to but spaced from the pan roll 2 with a gap 36 between the conforming rail and the pan roll 2. The length of the gap between the conforming rail 34 and the pan roller is referred to as the sector length 37. However, when overflowing decreases or stops, the level in the trough will recede raising the risk of nip starvation.

Means is provided to supply fluid to the trough to prevent dampening fluid starvation. To affect this, the conductivity probe 30 is used to detect the drop in level and to initiate a fluid feed through a feed line/valve combination from the supply system to replenish the nip so that the trough is again filled. Thus, the sensor 30 signals the controller 39 to control valve 38 which can open or close dampening fluid supply line 43.

In accordance with this invention means is provided to permit the trough to maintain a supply of fluid. As embodied both the sector length of the conforming trough and the clearance or gap between it and the roller are critical to successful operation. If the sector length 37 is too short and/or the gap 36 too large, fluid will leak out of the trough at a rate faster that can be maintained by the viscous pumping action of the moving roller surface. This pumping action is a result of the rotation of the pan roll in the counter clockwise direction which is against the force of gravity. On the other hand, if the gap 36 is too small, it may become plugged with ink globules causing the roller surface to pick up ink. It has been found that the minimum practical gap dimension is about 0.025 inches with the result that the minimum sector length is 1½ inches. Longer sector lengths can be utilized with corresponding wider gaps. In fact, if the sector length is increased so that the gap covers the lower half of the roller, the gap width can be increased without limit, but this is not considered desirable. Although the reasons why beneficial effects are achieved with this invention are not fully understood, it is theorized that they are due primarily to the very short mean fluid residence times which result in reducing the volume of fluid held by the metering roller pair. As an example, consider a press having a fluid consumption rate per plate cylinder of 2.0 U.S. gallons per hour. An existing fluid supply system has a storage volume ranging from three to five gallons, which results in a mean residence time of 90 to 150 minutes. In contrast, if only the metering nip is used for storage, as in the preferred embodiment, the mean residence time is only ⅓rd of a minute, or a factor of at least 250 lower than in an existing system.

In the embodiment shown in FIG. 7, a gap thickness of 0.025 inches and a sector length of 1½ inches will add approximately 0.2 minutes to the residence time while a relatively thick gap of ⅛ inch covering the bottom half of a 3½ inch diameter pan roller would add over 3½ minutes to the residence time, i.e. increase it over that in the preferred embodiment by a factor of ten. Thus, while thicker gaps and longer sectors can be utilized, it is preferred to use the minimum values in order to minimize fluid residence time.

It should be noted that this alternate embodiment of the invention is most suitable for use with hard surfaced pan rollers because the gap dimensions cannot be maintained with rubber pan rollers because they are not dimensionally stable. This is because the diameter of a rubber roller can and does vary due to heating and chemical changes caused by interactions with inks and washup solvents. However, when it can be used this alternate embodiment possesses the advantages of greater simplicity and lower cost. Another advantage is that cooling of the dampening system can be achieved by providing passages 40 in the conforming rail for the flow of a suitable coolant.

Figure 8:
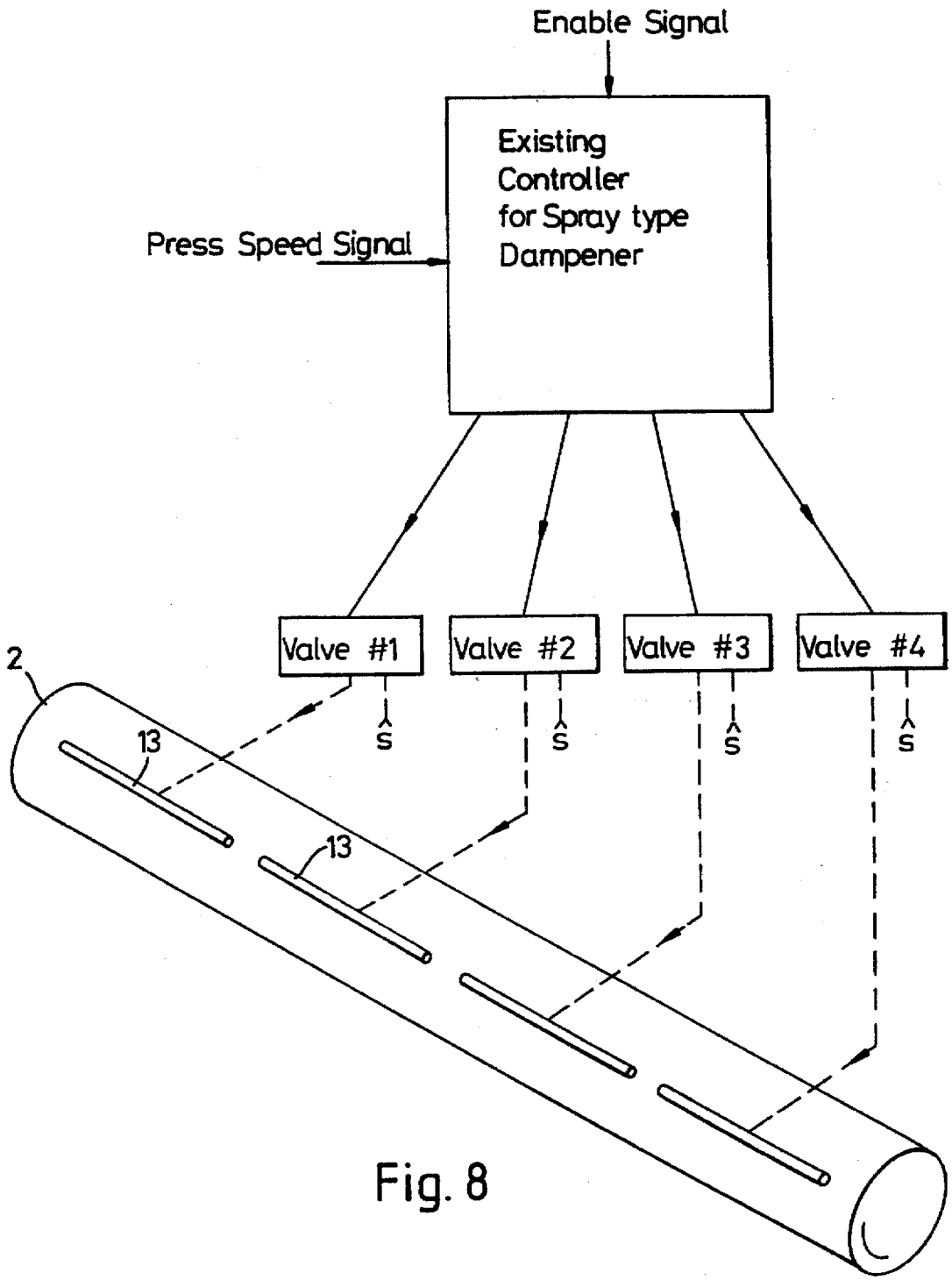
FIG. 8 is a schematic view of another embodiment of the invention showing various block diagrams of instrumentation.

In accordance with another embodiment of this invention the supply of dampening fluid is controlled by the speed of the press. As embodied, a second alternate embodiment is illustrated in FIG. 8. In this embodiment, a controller of the type described in U.S. Pat. No. 4,469,024 for a spray dampener is used to affect the flow of fluid through the valves and manifolds as schematically shown in FIG. 6. However, in this embodiment, instead of controlling dampening fluid supply by sensing overflowing of the metering nip, the duration between feeds and the length of feed is governed primarily by a program within the controller which increases the valve open time and/or decreases the interval between feeds in proportion to increases in press speed. The program is as in FIGS. 7A, 7B and 7C of U.S. Pat. No. 4,469,024 except that it is revised, and the press speed affects the controller as described in U.S. Pat. No. 4,469,024 with reference to numeral 26 which is the sensor that produces a signal proportional to press speed.

Referring to FIG. 8, there is shown a press speed signal generated by a sensor described above which is directed to controller for a spray type dampener of the type described in the U.S. Pat. No. 4,469,024. The controller signals valves #1, #2, #3 and #4 which in turn are connected to the manifold 13 which direct dampening fluid to the pan roller.

An additional feature of an embodiment of this type of controller is that a precise feedrate versus speed curve can be entered into the program by the press operator. Also the controller front panel has adjustments (e.g. control knobs) which allow the press operator to vary the feedrate in each zone by an amount equal to plus or minus 50% or more of the programmed amount.

Following installation on the press, the controller is programmed to deliver approximately twice the feedrate judged to be necessary by the pressman when printing a form with average ink coverage. Thus ample margin in feedrate will exist even when a heavy coverage form is run. This of course means that overflowing will occur at all times, with the excess fluid dripping into the pan. However this excess flow is very small and can be returned to the supply system by placing filter material inside the pan and collecting the fluid which draws therefrom. As a result the time between filter changes will be increased by a factor of several hundred over that in existing contact type dampeners. In addition, this excess flow will also act to reduce the mean fluid residence time. Further improvement in this regard can be realized by instructing the pressman to trim back feedrate, on each job run, in accordance with his visual observation of overflowing.

In accordance with another embodiment of this invention, the metering roller pair is rearranged wherein the metering nip is such that dampening fluid cannot drain away in a circumferential direction when the rollers stop moving. Thus the metering nip constitutes a reservoir capable of being replenished with dampening fluid so that the metering rollers can deliver dampening fluid in a manner that prevents contamination. As embodied in FIG. 9, this means includes a pair of metering rollers 50 and 51, having a nip 52 at their junction and means for controlling the supply fountain solution available for delivery to the metering nip 52.

Figure 9:
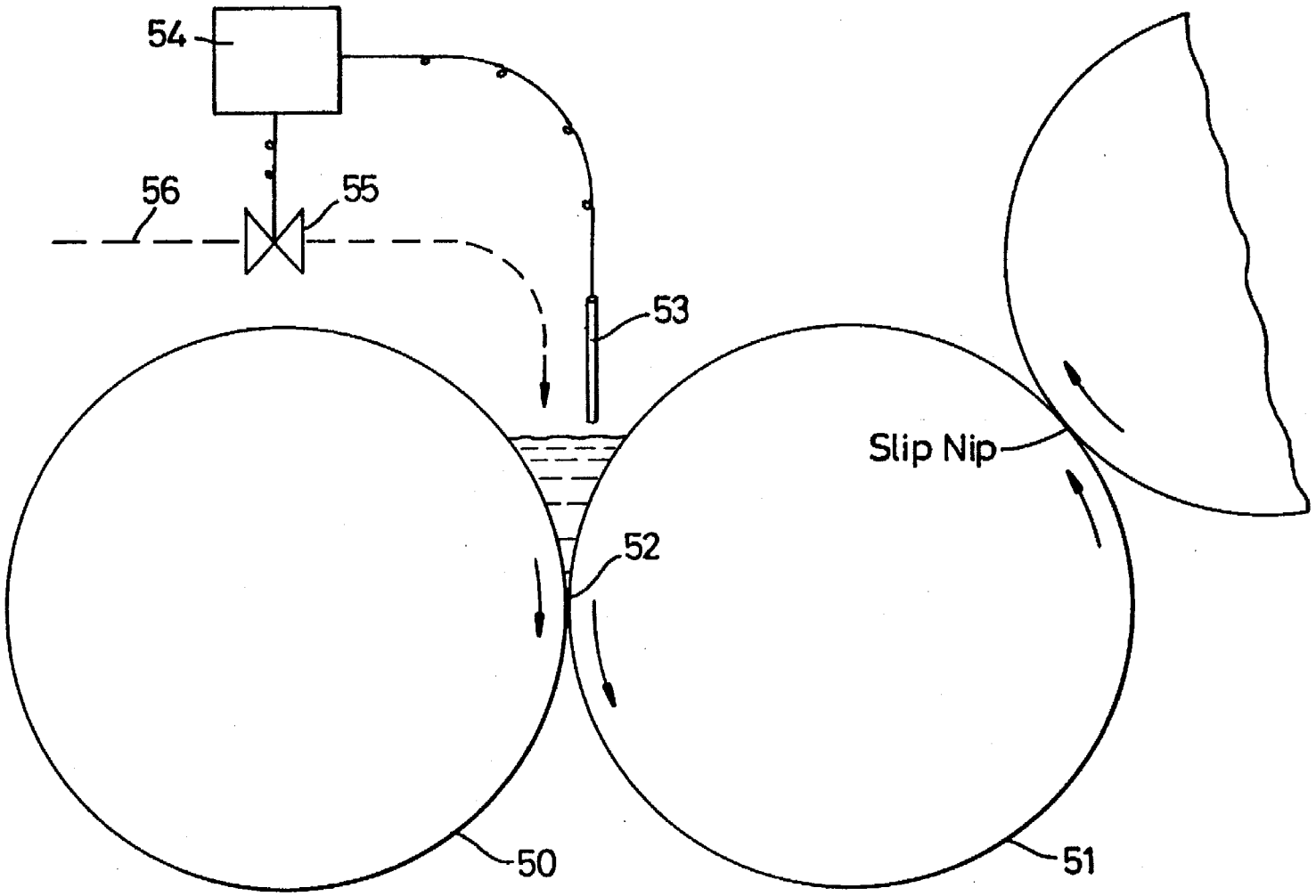
FIG. 9 is a schematic view of another embodiment of the invention.

In FIG. 9 there is shown sensing means used to determine the necessity of additional dampening fluid supply. As embodied, this means 53 consists of a single conductivity probe for detecting the presence of dampening fluid in the reservoir formed by the metering nip 52.

Means is provided to supply fluid to the nip to prevent dampening fluid starvation. To affect this, the conductivity probe 53 is used to detect the drop in level and to initiate a fluid feed through a feed line/valve combination from the supply system to replenish the nip so that the reservoir is again filled. Thus, the sensor 53 signals the controller 54 to control valve 55 which can open or close dampening fluid supply line 56.

It should be noted that this alternative embodiment of the invention is most suitable for use on new printing presses because of the relative ease of rearranging rollers, compared to the task on existing presses.

What is claimed is:

1. A dampening system for a lithographic press for minimizing contamination of dampening fluid by minimizing residence time of the dampening fluid in the dampening system comprising:

(a) a rotating plate cylinder mounted on the lithographic press and a pair of rollers adjacent said plate cylinder, (b) reservoir and metering system for feeding dampening fluid at a pre-determined rate to said plate cylinder by rotating said pair of rollers on said lithographic press at a slower speed than said plate cylinder, wherein said reservoir and metering system contains a volume of dampening fluid which is a small fraction of dampening fluid consumed by said press at said pre-determined rate over one hour, and wherein said reservoir and metering system includes a collection trough having a curved single radius surface spaced a pre-determined distance from the surface of one of said rollers and an inclined surface extending upwardly therefrom to form a widened trough;

(c) dampening fluid supply means for supplying a pre-determined supply of dampening fluid at said pre-determined rate supplied to said plate cylinder to said reservoir, and (d) sensor means for controlling said fluid supply means for preventing dampening fluid starvation while maintaining at least a volume of dampening fluid sufficient to supply dampening fluid at said pre-determined rate.

2. A dampening system as defined in claim 1 wherein said single radius surface is on substantially the same radius as one of said pair of rollers and has a pre-determined length.

3. The device as in claim 1 wherein said reservoir and metering system is dimensioned to contain a five minute supply of dampening fluid upon operation of said press at said pre-determined rate.

4. A device as defined in claim 1 wherein said pre-determined distance is at least 0.025 of an inch and said pre-determined length is at least 1½ inches.

5. The device as defined in claim 1 wherein said pre-determined length forms at least a portion of a means for preventing leakage.

6. A dampening system for a lithographic press for minimizing contamination of dampening systems by minimizing the residence time of any given particle of dampening fluid in the system comprising:

(a) a rotating plate cylinder mounted on the lithographic press, (b) a pair of rollers forming a pair of adjacent rollers on said lithographic press, means for rotating said pair of rollers at a slower speed than said plate cylinder, said pair of rollers having a nip therebetween containing a supply of dampening fluid, said pair of rollers adapted to supply dampening fluid to said plate cylinder at a pre-determined rate in an amount not in excess of the amount necessary, (c) a collection trough adjacent one of said rollers having an inclined surface extending along the length of one of said rollers, a curved surface extending from said inclined surface, said curved surface being spaced a pre-determined distance from the surface of use of said rollers and having substantially the same radius of curvature to form a sector of sufficient length in which dampening fluid is maintained, (d) means for supplying dampening fluid to said collection trough, and (e) sensor means for determining when dampening fluid starvation is about to occur for activating said dampening fluid supplying means.

7. A dampening system as defined in claim 6 wherein said curved surface is on substantially the same radius as one of said rollers and has a pre-determined length.

* * * * *